US009456649B2

(12) United States Patent
Basson

(10) Patent No.: US 9,456,649 B2
(45) Date of Patent: Oct. 4, 2016

(54) PROTECTIVE HELMET

(75) Inventor: Gilles Basson, Chatillon sur Chalaronne (FR)

(73) Assignee: MSA Production France, Chatillon sur Chalaronne (FR)

( * ) Notice: Subject to any disclaimer, the term of this patent is extended or adjusted under 35 U.S.C. 154(b) by 600 days.

(21) Appl. No.: 13/575,456

(22) PCT Filed: Jan. 26, 2011

(86) PCT No.: PCT/IB2011/000274

§ 371 (c)(1),
(2), (4) Date: Jul. 26, 2012

(87) PCT Pub. No.: WO2011/101722

PCT Pub. Date: Aug. 25, 2011

(65) Prior Publication Data

US 2012/0291185 A1 Nov. 22, 2012

(30) Foreign Application Priority Data

Feb. 19, 2010 (FR) ..... 10 51202

(51) Int. Cl.
*A42B 3/22* (2006.01)
*A42B 3/04* (2006.01)

(52) U.S. Cl.
CPC ..... *A42B 3/228* (2013.01); *A42B 3/042* (2013.01)

(58) Field of Classification Search
CPC ... A43B 3/042; A43B 3/0426; A43B 3/0406
USPC ..... 2/10, 6–6.8, 2, 424, 426, 247, 433, 432, 2/439; 345/409
See application file for complete search history.

(56) References Cited

U.S. PATENT DOCUMENTS

| | | | | |
|---|---|---|---|---|
| 2,277,090 | A * | 3/1942 | Feiler | 2/8.1 |
| 2,980,914 | A * | 4/1961 | Heisig et al. | 2/10 |
| 3,601,813 | A * | 8/1971 | Aileo | 2/410 |
| 4,828,378 | A | 5/1989 | Ellis | |
| 5,088,129 | A * | 2/1992 | Kamata | 2/411 |
| 5,119,505 | A | 6/1992 | Tisseront et al. | |
| 5,219,880 | A * | 6/1993 | Thornfeldt | 514/450 |
| 5,483,699 | A * | 1/1996 | Pernicka | A42B 3/08 2/424 |
| 5,584,073 | A | 12/1996 | Radzelovage et al. | |
| 5,688,039 | A * | 11/1997 | Johnson | 362/106 |
| 5,787,513 | A * | 8/1998 | Sharmat et al. | 2/411 |
| 6,282,726 | B1 * | 9/2001 | Noyerie | A42B 3/226 2/424 |

(Continued)

FOREIGN PATENT DOCUMENTS

| | | | |
|---|---|---|---|
| EP | 1895865 | A1 | 3/2008 |
| JP | 61288525 | A | 12/1986 |
| WO | 02071879 | A1 | 9/2002 |

*Primary Examiner* — Robert J Hicks
*Assistant Examiner* — Timothy K Trieu
(74) *Attorney, Agent, or Firm* — The Webb Law Firm

(57) ABSTRACT

A helmet includes a shell, a support element mounted on the shell, on the outer side thereof and above the facial opening, and at least a first visor mounted pivoting in relation to the shell around a pivot axis, between a lowered use position and a high retracted position. An articulating means is provided between the support element and the shell, to allow said support element to pivot in relation to the shell around a transverse axis situated in the vicinity of the back edge of the support element, between a lowered use position, in which said support element covers a portion of the shell, and a raised position. A locking means is also provided for locking the support element in the lowered position.

19 Claims, 4 Drawing Sheets

(56) References Cited

U.S. PATENT DOCUMENTS 6,438,763 B2 * 8/2002 Guay et al. ..... 2/424
6,490,729 B1 * 12/2002 Dondero ..... 2/10
2002/0148032 A1 10/2002 Basson et al.
2004/0143888 A1 7/2004 Bataille et al.
2007/0114252 A1 5/2007 Gruebel et al.

* cited by examiner

PROTECTIVE HELMET

CROSS REFERENCE TO RELATED APPLICATIONS

This application claims priority to French Patent Application No. FR10/51202, filed Feb. 19, 2010, which is incorporated herein by reference in its entirety.

BACKGROUND OF THE INVENTION

1. Field of the Invention

The present invention relates generally to protective helmets and headwear, and in particular to helmets worn by specific personnel in certain environments, including helmets worn by airplane or helicopter flight personnel.

2. Description of Related Art

A helmet typically includes a rigid outer shell having a generally spherical shape, intended to cover the wearer's head, and a facial opening for the wearer's face. Moreover, the helmet includes one (or several) visor(s) that can pivot between a lowered usage position, in which it extends in front of the facial opening of the helmet, and a high retracted position, in which it is situated above the facial opening.

Certain helmets are provided with a support element (also called a dome) that protects the visor(s) and fastens a night vision device or other accessory. This support element generally includes a substantially sphere portion-shaped wall, and this wall is mounted on the shell, on the outside thereof, and above the facial opening. When it is in the high position, the visor is housed under the dome.

On known helmets, the dome is mounted on the shell removably by a connection and locking system including snapping means and/or fastening means, such as screws. When one wishes to change the visor, either because it is worn or because another type of visor must be put into place for the next use of the helmet, it is first necessary to undo the connection and locking system. The dome can then be removed from the shell, which allows access to the visor.

This has several drawbacks. First, the placement and removal of the dome generally require tools and can be awkward. Moreover, once the dome is removed, there are two separate parts, i.e. the shell and the dome, which can pose practical problems. Moreover, separating the dome from the shell leads to the risk of tearing the cables that enable the electrical connection of the night vision device fastened on the dome, as well as the risk of losing parts.

SUMMARY OF THE INVENTION

Generally, the present invention provides a protective helmet that addresses some or all of the aforementioned drawbacks and deficiencies. Preferably, the present invention provides a protective helmet that is simple to handle and maneuver. Preferably, the present invention provides a protective helmet that facilitates the fast and simple changing of a visor. Preferably, the present invention provides a protective helmet that works in connection with multiple visors.

In one preferred and non-limiting embodiment, provided is a protective helmet, which includes: a rigid shell having a facial opening; a support element including a substantially sphere portion-shaped wall mounted on the shell, on the outside thereof and above the facial opening; and at least a first visor pivotably mounted in relation to the shell around a pivot axis, between a lowered use position, in which the first visor extends in front of the facial opening, and a raised retracted position, in which the first visor is housed between the shell and said wall of the support element. Further, the protective helmet includes articulating means between the support element and the shell, arranged to allow said support element to pivot in relation to the shell around a transverse axis situated in the vicinity of the back edge of the support element, between a lowered use position, in which said wall of the support element covers a portion of the shell, and a raised position; and means for locking the support element in the lowered position. In a further preferred and non-limiting embodiment, the articulating means is hinge means.

Thus, the helmet according to the invention enables quick and easy access to the visor (or to the various visors, if applicable) to change it as needed. Indeed, to that end, one need only release the locking means, then perform a simple pivoting of the support element to place it in the raised position. The support element therefore does not need to be disassembled to enable access to the screen, and the use of tools is superfluous. Moreover, with the support element remaining fastened to the helmet, there is no risk of it being lost. Furthermore, when the support device serves as support for a night vision device, this hinged structure makes it possible to avoid the risk of pulling out the electrical power cables when one wishes to change the visor. The visor may be, for example, mounted pivoting around a first transverse pivot axis integral with the shell.

According to a further preferred and non-limiting embodiment, the protective helmet also includes a second visor mounted on the support element, on the inner side thereof, so as to pivot around a second transverse pivot axis that is fixed in relation to the support element. This second visor is configured to pivot between a high retracted position, in which the second visor is positioned opposite the inner face of the support element, and a lowered use position, in which the second visor extends in front of the facial opening when the support element is in the lowered position. The presence of two visors makes it possible to better meet the needs of the helmet's wearer, who can choose to use one or the other of the visors. The support device here serves as support for the second visor. By raising the support element owing to the hinge means, it is possible to very easily access the second visor to change it, independently of the first visor. According to another preferred and non-limiting embodiment, the first and second pivot axes are substantially combined, when the support element is in its lowered position.

In a further preferred and non-limiting embodiment, the helmet includes means for actuating the pivoting of the visor(s), where the actuating means is situated on a side portion of the shell, near the pivot axis of said visor. In a still further preferred and non-limiting embodiment, the helmet includes first and second means for actuating the pivoting of the first and second visors, respectively, where the first actuating means is situated on a first side portion of the shell and the second actuating means is situated on a second side portion of the shell. Thus, the visors can easily be manipulated independently of each other.

In another preferred and non-limiting embodiment, the support element includes two side guideways each in the shape of an arc of circle centered on the second pivot axis and the second visor includes side members each able to cooperate with one of the guideways. For example, the means for locking the support element in the lowered position on one hand comprise at least one side lug formed on the support element and provided with a hole in which a screw is removably inserted, and on the other hand a tapped housing for receiving the screw, formed on the side portion of the shell. The advantage of this embodiment is the ease of implementation of the locking means and their unlosable nature.

In a further preferred and non-limiting embodiment, the shell has, above the facial opening, a portion withdrawn towards the inside in relation to the rest of the shell, in which the support element is able to be housed when it is in the lowered position. In this position, the helmet has a globally spherical shape substantially without excess thickness due to the presence of the support element. Thus, the risk of the helmet catching on various outside elements is significantly decreased. This is particularly important in the application to an airplane or helicopter helmet, intended to be worn in a limited space including numerous control members and connection cables of a nature to catch on protruding portions of the helmet. Moreover, this structure makes it possible to integrate two visors into the helmet without local increase in the outer volume of the helmet, while preserving easy access to the visors owing to the hinge means. This structure also makes it possible to place the night vision device closer to the helmet wearer's eyes.

In a still further preferred and non-limiting embodiment, the helmet includes an electronic connection device mounted on the shell at the lower part of the rear portion thereof, and an electrical power cable that, connected to said power supply device, extends under the shell, through an orifice formed in the shell in front of the hinge means of the support element, then extends under the support element to holes formed in the support element to allow the electrical connection with a night vision device, for example. Due to the presence of the hinge means, which do not require the support element to be completely removed in relation to the shell, pulling out of the cables is avoided when the support element is raised to change the visor(s). In practice, the cable is fastened under the shell and under the support element, and is protected by a piece, called a cap, fastened under the shell. For example, the cable substantially borders the longitudinal plane of symmetry of the helmet.

In another preferred and non-limiting embodiment, provided is a protective helmet, including: a shell configured for removable placement over a user's head, the shell having a front portion defining a recess; a support member moveably attached to the shell and configured to move between a first position wherein a bottom edge of the support member is spaced from the front portion of the shell and a second position wherein the support member is positioned at least partially within the recess; and at least one visor configured to move between a first position adjacent an inner surface of the support member and a second position at least partially extending from the bottom edge of the support member.

In a still further preferred and non-limiting embodiment, the present invention is for use in connection with a protective helmet having a shell having a front portion defining a recess and configured for removable placement over a user's head. This embodiment includes a support member moveably attached to the shell and configured to move between a first position wherein a bottom edge of the support member is spaced from the front portion of the shell and a second position wherein the support member is positioned at least partially within the recess; and at least one visor configured to move between a first position adjacent an inner surface of the support member and a second position at least partially extending from the bottom edge of the support member.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENT(S)

Figure 1:
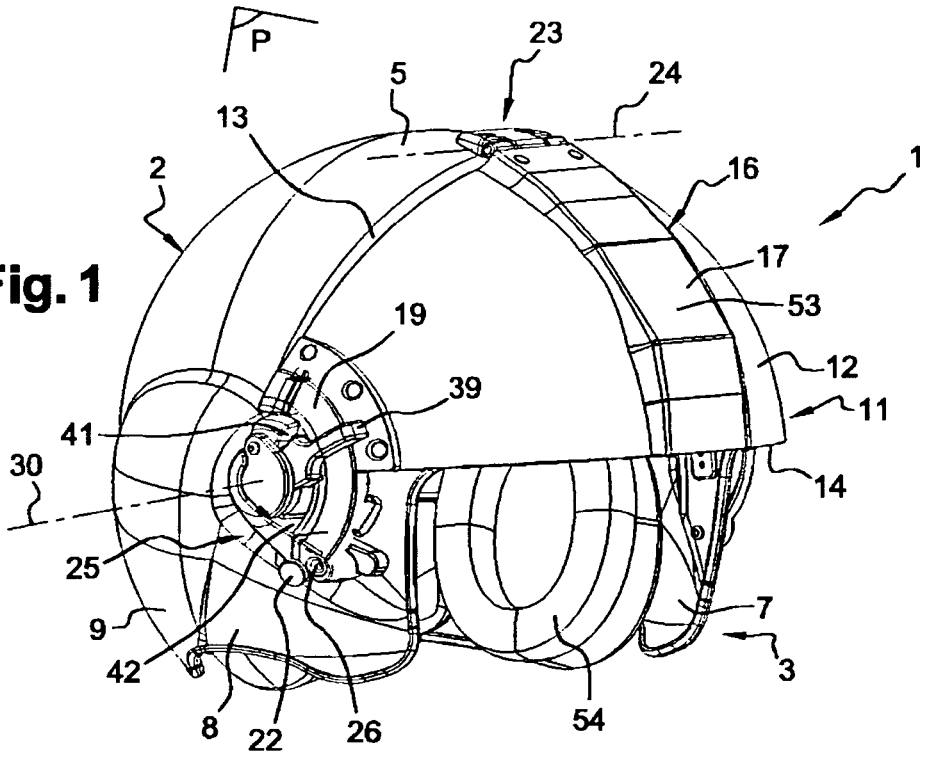
FIG. 1 is a front perspective view of one embodiment of a protective helmet according to principles of the present invention, where a support element is in the lowered, but not locked, position, and first and second visors are in the high retracted position.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

With reference to FIGS. 1-8, provided is a helmet 1, which includes a rigid shell 2 that is intended to fit a wearer's head, and is, for example, made from a composite material. The shell 2 has a longitudinal plane of symmetry P, as illustrated in FIG. 1. For reference, the helmet 1 is described in the position it occupies when it is placed on the wearer's head, as shown in the figures. The transverse direction is defined as the direction orthogonal to the plane P, this direction therefore being horizontal. The term "inner" is used to designate an element closer to the wearer's head, as opposed to the term "outer."

The shell 2 has a generally spherical shape and has a facial opening 3 for the wearer's face. The shell 2 includes: a front portion 4, situated above the facial opening 3, an upper portion 5, a back portion 6 extending from the upper portion 5 to the wearer's neck, as well as a left side portion 7 and a right side portion 8, each extending from the upper portion 5 on either side of the facial opening 3. The side portions 7, 8 can include bulges 9 at the wearer's ears. Moreover, the front portion 4 of the shell 2 is situated withdrawn, towards the inside, in relation to the upper portion 5, thereby forming a step 10 between the front 4 and upper 5 portions.

The helmet 1 also includes a support element 11, also called a dome, that can serve as protection means for the visor(s) and support for a night vision device, among other things. The dome 11 includes a wall 12, which is, for example, made from a composite material. The wall 12 is substantially sphere portion-shaped. It is limited on one hand by a back edge 13 and a front edge 14, both substantially forming a meridian of said sphere portion, and on the other hand by two arcs of circle-shaped side edges 15. The wall 12 has a longitudinal rib 16 including at least one planar face 17 for fastening a night vision device (not shown).

The dome 11 further includes two side connecting parts 18. Each side connecting part 18 is fastened in the vicinity of a side edge 15 of the wall 12, and includes an arc of a circle-shaped lug 19 extending from the back edge 13 beyond the front edge 14, over an angle between 90° and 130°, for example in the vicinity of 110°. The lug 19 includes, on its inner face, an arc of a circle-shaped guideway 20. Moreover, at its front end part, the lug 19 includes a hole 21 in which a screw 22 is removably engaged.

The dome 11 is mounted on the shell 2 via articulating means 23, which may be a hinge-type articulating means, positioned in the vicinity of the plane P. A first part of this articulating means 23 is fastened on the shell 2, substantially immediately behind the step 10, whereas a second part is fastened in the vicinity of the back edge 13. The articulating means 23 defines a transverse axis 24 substantially tangent to the upper portion 5 of the shell 2 and situated near the back edge 13, around which the dome 11 is able to pivot. Thus, the dome 11 can occupy: (1) a lowered use position, in which the dome 11 substantially covers the front portion 4 of the shell 2, on the outer side, between the step 10 and the upper edge of the facial opening 3 (see FIG. 1); and (2) a raised position, in which the dome 11 is spaced away from the front portion 4 of the shell 2, but remains connected to the shell 2 (see FIG. 3). As shown more particularly in FIGS. 1 and 2, when the dome 11 is in the lowered position, it is housed in the recess formed by the front portion 4 of the shell 2 that is withdrawn towards the inside in relation to the upper portion 5. Thus, in this position, the helmet 1 has a globally spherical shape and substantially no excess thickness due to the presence of the dome 11. In one preferred and non-limiting embodiment, the pivot amplitude of the dome 11 can be in the vicinity of 120°.

The helmet 1 is generally provided with two side devices 25 each arranged at a side portion 7, 8 of the shell 2, in front of a bulge 9. Each side device 25 includes a tapped housing 26 for receiving the screw 22 mounted on the corresponding lug 19 of the dome 11, to form means for locking the dome 11 in the lowered position. Moreover, each side device 25 includes a part 27 that has a cylindrical peripheral surface 28 with a transverse axis and that is provided with a pin 29 extending transversely outwardly. The two pins 29 are aligned and define a transverse axis 30.

The helmet 1 also comprises a first visor 31 and a second visor 32. The first visor 31 includes a main part 33 in the shape of a sphere portion whereof the lower edge 34 is provided with a notch 35 for the nose of the helmet 1 wearer. The main part 33 is extended by two side arms 36 oriented globally rearward. The free end part of the arms 36 includes a hole 37 that engages on the corresponding pin 29, while the middle part of the arms 36, oriented radially, has a cylindrical rear face 38 adapted to the cylindrical peripheral surface 28 of the corresponding side device 25.

The first visor 31 can thus clip on the two pins 29, while the cylindrical surfaces 28, 38 engage. The first visor 31 can therefore pivot, in relation to the shell 2 and around the axis 30, between: (1) a lowered use position, in which the first visor 31 extends in front of the facial opening 3 (see FIG. 2); and (2) a high retracted position, in which the first visor 31 is housed between the front portion 4 of the shell 2 and the wall 12 of the dome 11 (see FIGS. 1, 7, and 8).

A control lever 39 is formed on one of the arms 36 of the first visor 31 (e.g., the right arm) to allow the wearer of the helmet 1 to pivot the first visor 31 as needed. Moreover, a closing piece 40 is hinged on each side device 25. This closing piece 40 can occupy a blocking position (FIG. 2), in which it is snapped on the side device 25 and covers the corresponding pin 29 to prevent the untimely release of the first visor 31. By detaching the closing piece 40 and making it pivot around its axis, access to the pins 29 is freed (see FIG. 6) so as to be able to separate the first visor 31 from the shell 2 when one wishes to change that visor.

Figure 2:
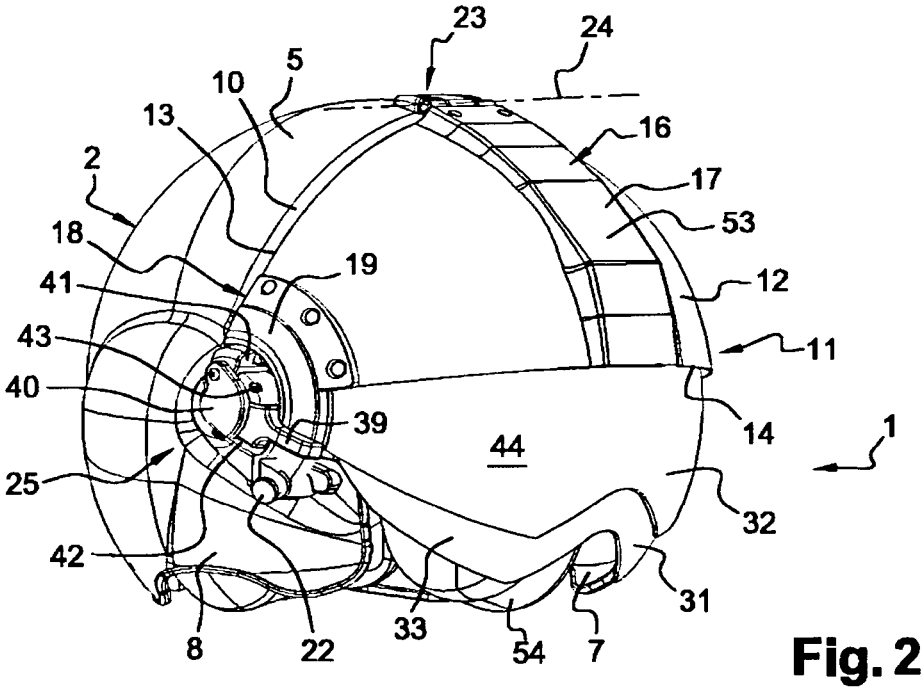
FIG. 2 is a front perspective view of the protective helmet of FIG. 1, where the support element is locked in the lowered position and the visors are in the lowered use position.

A means is provided making it possible to limit the pivoting of the first visor 31 in both directions. As shown in FIG. 1, and in practice, the side arms 36 abut against an upper 41 or lower 42 radial wall of the corresponding side device 25. Moreover, as illustrated in FIG. 2, a cavity 43 is provided in the cylindrical peripheral surface 28 of the side device 25 to receive a lug (not shown) formed in the corresponding arm 36 of the first visor 31 and stressed outwardly, in order to keep the first visor 31 in the high position. Pivoting towards the low position requires a certain force to make the lug leave the cavity 43, and the first visor 31 is thereby prevented from untimely downward pivoting.

The second visor 32 includes a main part 44 in the shape of a sphere portion whereof the lower edge 45 is provided with a notch 46 for the nose of the helmet 1 wearer. The second visor 32 also includes side members 47 able to cooperate with one of the guideways 20 formed on the dome 11. The second visor 32 is mounted on the inner side of the dome 11 and can slide in relation thereto (see FIGS. 3 and 4).

When the dome 11 is in the lowered position, the arc of circle-shaped guideways 20 are centered on the transverse axis 30. The second visor 32 can therefore pivot, in relation to the shell 2 and around the axis 30, between: (1) a lowered use position, in which the second visor 32 extends in front of the facial opening 3 (see FIG. 2), the second visor 32 being able to be superimposed on the first visor 31 while being situated on the outer side; and (2) a high retracted position, in which the second visor 32 is housed under the wall 12 of the dome 11 (see FIGS. 1, 3, and 7).

Figure 3:
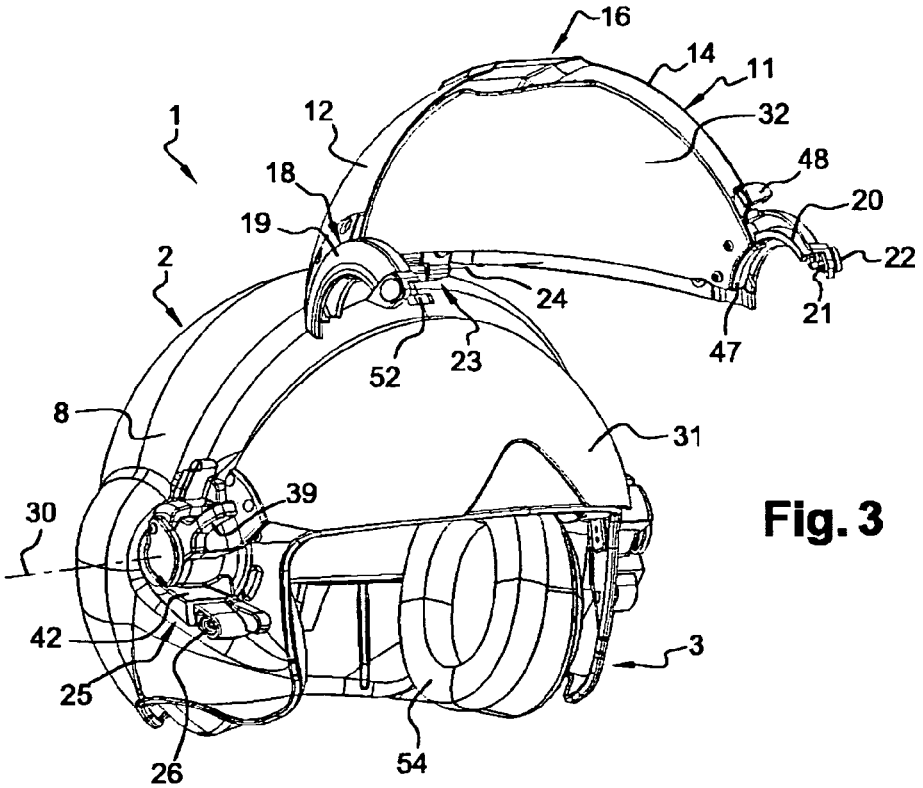
FIG. 3 is a front perspective view of the protective helmet of FIG. 1, where the support element is in the raised position and screens are in the high retracted position.
Figure 4:
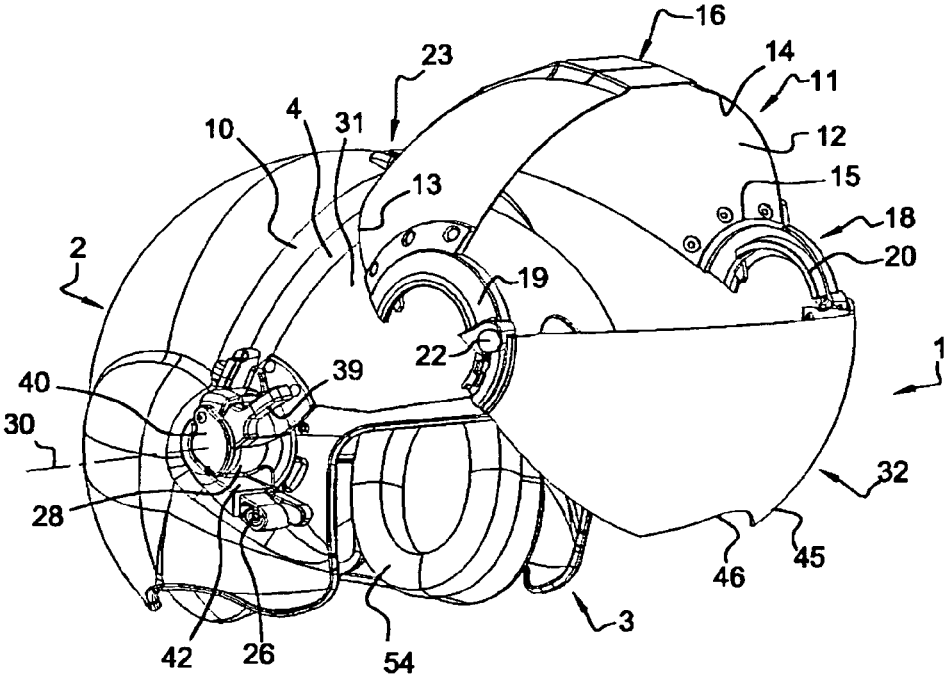
FIG. 4 is a front perspective view of the protective helmet of FIG. 3, where the second visor is pivoted downwards for removal.

A control lever 48 is formed on the second visor 32, to allow the wearer of the helmet 1 to pivot the second visor 32 as needed. The lever 48 is situated near the side edge of the second visor 32, preferably the edge opposite the control lever 39 of the first visor 31 (e.g., the left side), in order to facilitate manipulation of the visors 31, 32 independently of each other. Further, a means is provided making it possible to limit the pivoting of the second visor 32 in both directions. As seen in FIG. 3 and in practice, the lever 48 abuts against the front edge 14 of the dome 11. Moreover, a means is provided to keep the second visor 32 in the high position and prevent it from untimely downward pivoting. This may for example involve a cavity formed on the dome 11 and able to receive a lug provided on the second visor 32, and stressed outwardly.

Figure 5:
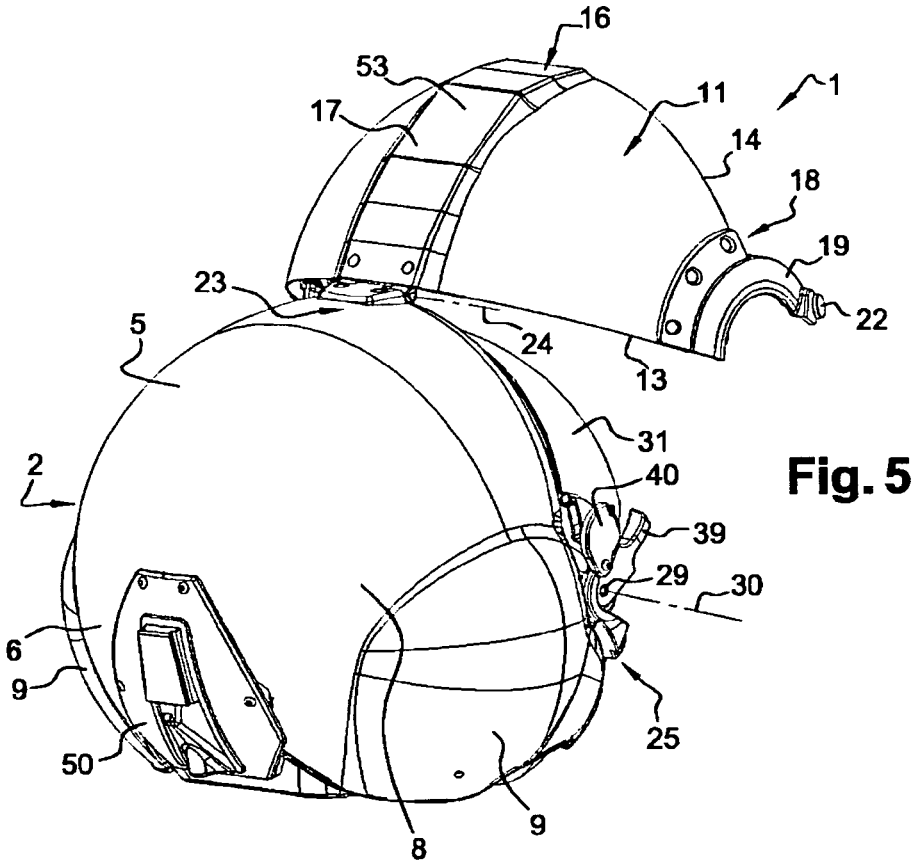
FIG. 5 is a rear perspective view of the protective helmet of FIG. 3, where locking means of the first visor are unlocked.
Figure 6:
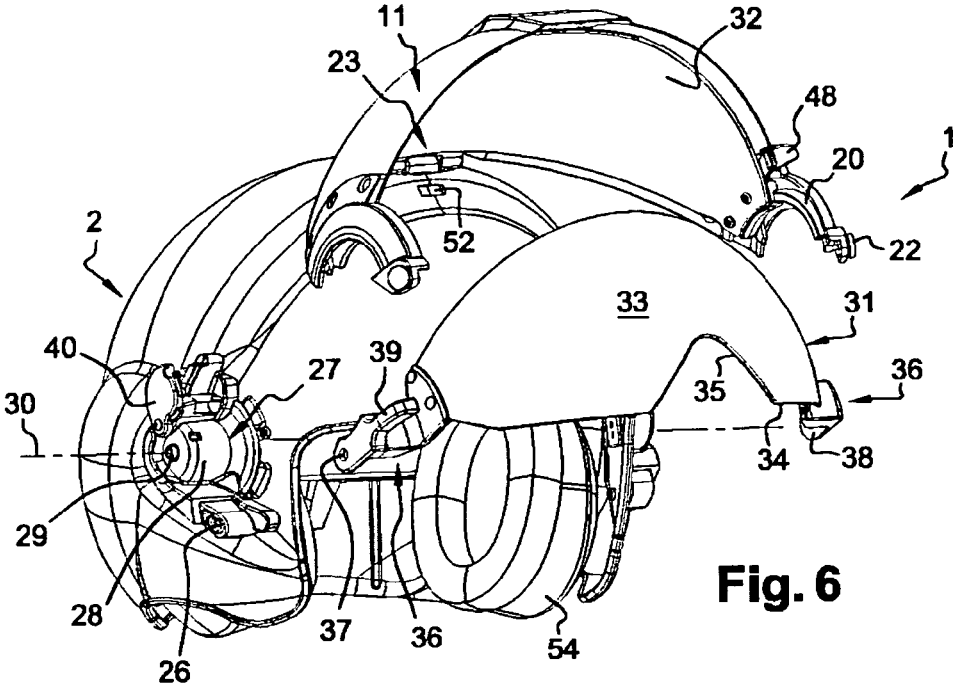
FIG. 6 is a front rear perspective view of the protective helmet of FIG. 3, where the first visor has been removed.
Figure 7:
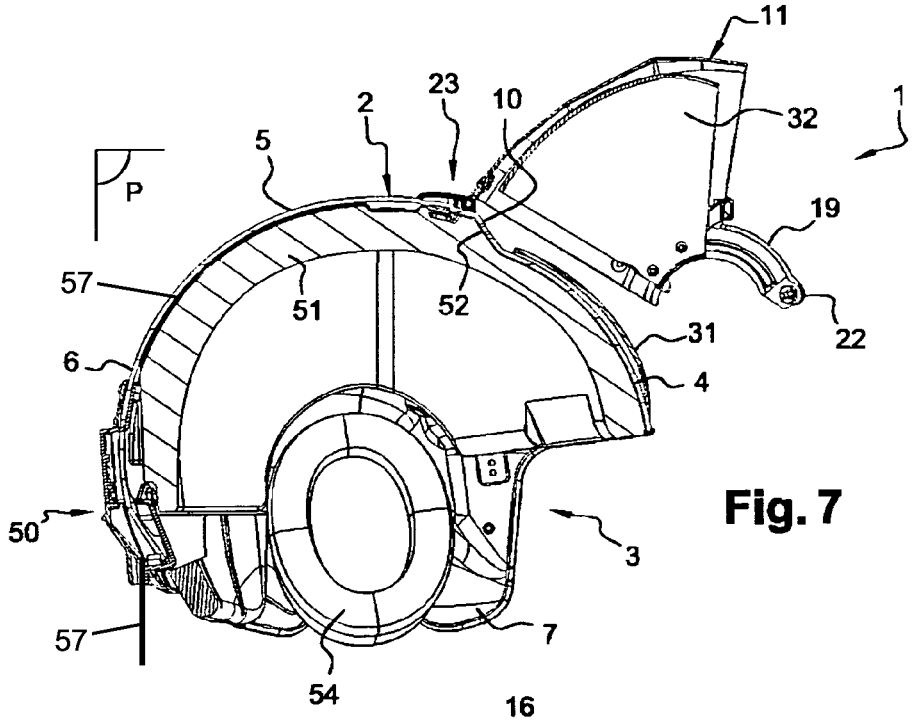
FIG. 7 is a cross-sectional view along the longitudinal plane of symmetry of the protective helmet of FIG. 3.
Figure 8:
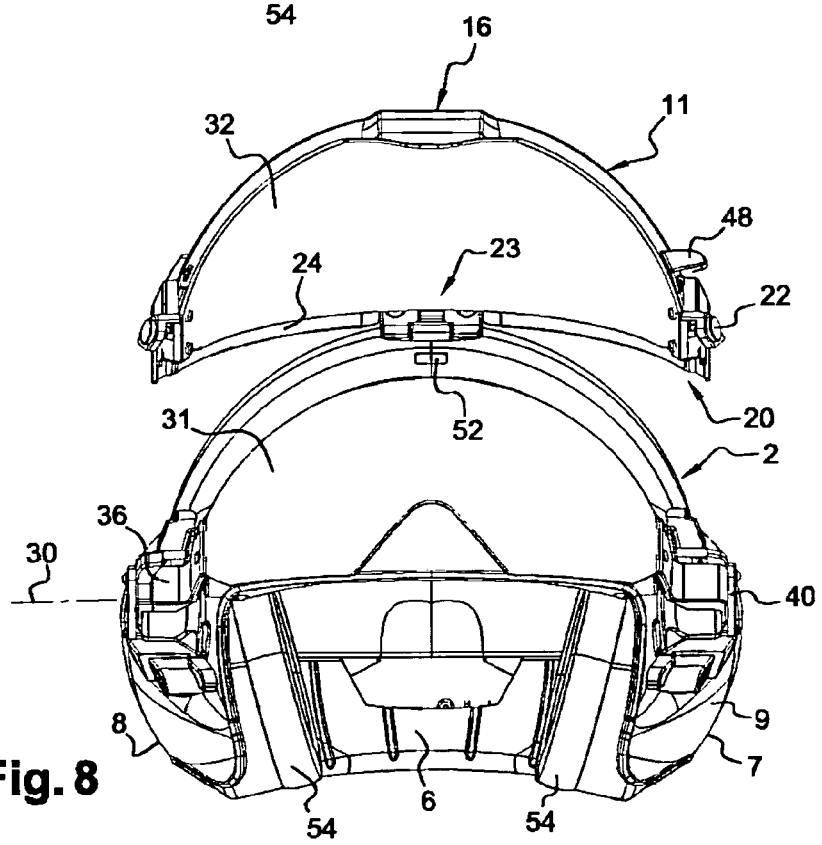
FIG. 8 is a front view of the protective helmet of FIG. 3.

As illustrated in FIGS. 5 and 7, the helmet 1 also comprises an electronic connecting device 50 mounted on the lower part of the rear portion 6 of the shell 2. This electronic connecting device 50 can power, inter alia, a communication system, a mouth lamp and/or a night vision device fastened on the dome 11. The connection between the electronic connecting device 50 and the night vision device is done using a cable that generally assumes the form of an electronic layer.

The cable 57 is fastened under the shell 2 substantially along the plane P, while being protected under the damping and/or padding elements 51, which include a cap generally made from polystyrene. These elements 51 also include aural cavities 54 that are positioned at the wearer's ears to form protection against noise. The cable then passes through an orifice 52 formed in the shell 2 in front of the articulating means 23, substantially at the step 10 (see FIG. 7). The cable is then fastened under the dome 11 up to holes 53 (shown in FIG. 1) formed in the face 17 to enable the electric connection with the night vision device.

In one preferred and non-limiting embodiment, when the helmet 1 is in the use position, the two visors are situated outside the shell 2, and under the dome 11 when they are retracted. The two visors 31, 32 can be superimposed, at least partially, both when they are in the lowered use position and when they are in the high retracted position, the second visor 32 being situated on the outer side in relation to the first visor 31. From the position illustrated in FIG. 1, the wearer of the helmet 1 can pivot the first visor 31 and/or the second visor 32 downward.

When at least one of the visors must be changed, the screws 22 are unscrewed to allow them to be disengaged outside the tapped housings 26 provided in the side devices 25. The dome 11 can then be raised owing to articulating means 23, without risk of pulling out the cables. It is then possible to change either one of the visors 31, 32, independently of the other. To make this change, the first visor 31 must be unclipped from the pins 29, after pivoting of the closing piece 40; the second visor 32 must be moved until it is released from the guideways 20.

The various aforementioned manipulations are simple and quick, and do not require any tools. Moreover, the various fastening or locking elements cannot be lost.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A protective helmet comprising:

a rigid shell and a facial opening;

a support element including a substantially sphere portion-shaped wall mounted on an outside portion of the shell above the facial opening;

a first visor pivotably mounted in relation to the shell around a first transverse pivot axis, between a lowered use position, in which the first visor extends in front of the facial opening, and a raised retracted position, in which the first visor is received between the outside portion of the shell and said wall of the support element;

an articulating member between the support element and the shell, the articulating member arranged to allow said support element to pivot in relation to the shell around a transverse axis situated in a vicinity of a back edge of the support element, between a lowered use position, in which said wall of the support element covers a portion of the shell, and a raised position;

a locking member for locking the support element in the lowered position; and a second visor mounted on an inner face of the support element so as to pivot around a second transverse pivot axis that is fixed in relation to the support element, the second visor pivotable between a high retracted position, in which the second visor is positioned opposite the inner face of the support element, and a lowered use position, in which the second visor extends in front of the facial opening when the support element is in the lowered position.

2. The helmet according to claim 1, wherein the first visor is pivotably mounted around the first transverse pivot axis integral with the shell.

3. The helmet according to claim 1, wherein the first transverse pivot axis and the second transverse pivot axis are substantially coaxial when the support element is in the lowered use position.

4. The helmet according to claim 1, further comprising an actuating member pivoting at least one of the first visor and the second visor, said actuating member positioned on a side portion of the shell, in a vicinity of at least one of the first transverse pivot axis and the second transverse pivot axis.

5. The helmet according to claim 1, further comprising a first actuating member for pivoting the first visor and a second actuating member for pivoting the second visor, the first, actuating member provided on a first side portion of the shell and the second actuating member provided on a second side portion of the shell.

6. The helmet according to claim 1, wherein the support element includes two arc-shaped side guideways centered relative to the second transverse pivot axis and wherein the second visor includes side members configured to cooperate with at least one of the guideways.

7. The helmet according to claim 1, wherein the locking member has, at a first end, at least one side lug formed on the support element and provided with a hole in which a fastener is removably inserted, and, at a second end, a tapped housing for receiving the fastener, the tapped housing formed on the side portion of the shell.

8. The helmet according to claim 1, wherein the shell has, above the facial opening, a recessed portion recessed inwardly in relation to the rest of the shell such that the support element is positioned over the recessed portion when the support element is in the lowered position, such that the helmet has a globally spherical shape substantially without excess protrusions due to a presence of the support element.

9. The helmet according to claim 1, further comprising an electronic connection device mounted on the shell at a lower part of a rear portion of the shell, and an electrical power cable that, connected to said electronic connection device, extends under the shell, through an orifice formed in the shell in front of the articulating member, and extends under the support element to at least one opening formed in the support element to allow an electrical connection with a night vision device.

10. A protective helmet, comprising:

a shell configured for removable placement over a user's head, the shell having a front portion defining a recess;

a support member moveably attached to the shell and configured to move between a first position wherein a bottom edge of the support member is spaced from the front portion of the shell and a second position wherein the support member is positioned at least partially within the recess; and at least one visor configured to move relative to the support member and the shell between a first position adjacent an inner surface of the support member and a second position at least partially extending from the bottom edge of the support member;

wherein the recess is recessed inwardly in relation to the rest of the shell such that the support member is positioned over the recess when the support member is in the first position, such that the helmet has a substantially globally spherical shape without protrusions due to a presence of the support member.

11. The protective helmet of claim 10, further comprising a releasable locking arrangement for locking the support member in the second position.

12. The protective helmet of claim 11, wherein the releasable locking arrangement comprises a first locking arrangement positioned at at least one side portion of the shell and a second locking arrangement positioned at at least one side portion of the support member.

13. The protective helmet of claim 12, wherein the first locking arrangement comprises at least one threaded orifice and the second locking arrangement comprises at least one screw configured to threadedly engage the threaded orifice, whereby the support member can be locked in the second position by engaging the screw with the threaded orifice and unlocked by disengaging the screw with the threaded orifice, and thereby allowing the support member to be moved to the first position.

14. The protective helmet of claim 10, wherein the at least one visor is removably engaged with an attachment arrangement connected to at least one side portion of the shell.

15. The protective helmet of claim 10, wherein the at least one visor is slidingly engaged with a guide arrangement connected to an inner surface of the support member.

16. The protective helmet of claim 10, further comprising at least one stop surface configured to restrict movement of the at least one visor.

17. The protective helmet of claim 10, wherein the at least one visor comprises:

a first visor rotatably attached to an attachment arrangement connected to at least one side portion of the shell; and a second visor slidingly engaged with a guide arrangement connected to an inner surface of the support member.

18. The protective helmet of claim 17, wherein the first visor comprises a hole that is releasably engageable with a pin forming part of the attachment arrangement, and the second visor comprises a side member configured to slidingly engage a recess forming part of the guide arrangement.

19. A protective helmet having a shell having a front portion defining a recess and configured for removable placement over a user's head, a support member movably attached to the shell and configured to move between a first position wherein a bottom edge of the support member is spaced from the front portion of the shell and a second position wherein the support member is positioned at least partially within the recess; and at least one visor moving relative to the support member and the shell between a first position adjacent an inner surface of the support member and a second position at least partially extending from the bottom edge of the support member, further comprising an electronic connection device mounted on the shell at a lower part of a rear portion of the shell, and an electrical power cable that, when connected to said electronic connection device, extends under the shell, through an orifice formed in the shell in front of an articulating member, and extends under the support member to at least one opening formed in the support element to allow an electrical connection with a night vision device.

* * * * *